US007878847B2

(12) United States Patent
He et al.

(10) Patent No.: US 7,878,847 B2
(45) Date of Patent: Feb. 1, 2011

(54) ELECTRICAL CONNECTOR WITH IMPROVED CONTACT ARRANGEMENT

(75) Inventors: Jia-Yong He, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/660,776

(22) Filed: Mar. 3, 2010

(65) Prior Publication Data

US 2010/0227509 A1 Sep. 9, 2010

(30) Foreign Application Priority Data

Mar. 3, 2009 (CN) ..... 2009 2 0301021

(51) Int. Cl.
*H01R 13/73* (2006.01)

(52) U.S. Cl. ..... 439/541.5

(58) Field of Classification Search ..... 439/541.5, 439/79, 80

See application file for complete search history.

(56) References Cited

U.S. PATENT DOCUMENTS 7,467,977 B1 * 12/2008 Yi et al. ..... 439/607.01
2010/0136806 A1 * 6/2010 Chen et al. ..... 439/79

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical connector includes an insulative housing and a number of first and second contacts retained therein. The insulative housing defines a first receiving cavity with a first tongue extending thereinto and a second receiving cavity with a second tongue extending thereinto. The second receiving cavity communicates with the first receiving cavity in an up to down direction. The first contacts are disposed on opposite first and second surfaces of the first tongue. Each first contact has a first contact portion protruding into the first receiving cavity and a first tail portion. The second contacts are disposed on a mounting surface of the second tongue. Each second contact has a flat second contact portion exposed to the second receiving cavity and a second tail portion. All first tail portions and second tail portions extend out of the insulative housing and are arranged in a row.

9 Claims, 6 Drawing Sheets

ELECTRICAL CONNECTOR WITH IMPROVED CONTACT ARRANGEMENT

BACKGROUND OF THE INVENTION

1. Field of the Invention

The present invention relates to electrical connectors, more particularly to electrical connectors with improved contact arrangement.

2. Description of Related Art

USB 3.0 proposal was standardized by the USB Implementers Forum (USB-IF) at the end of 2008. An USB 3.0 B type connector includes an insulative housing and USB 2.0 contacts and extension contacts retained therein. Each contact has a contact portion to mate with a mating connector and a vertical tail portion extending out of the insulative housing for connecting with a circuit board. The insulative housing has two parallel tongue portions to retain the contact portions of USB 2.0 contacts and extension contacts respectively. The tail portions of all USB 2.0 contacts are arranged in two rows along an insertion direction of the mating connector, and the tail portions of all extension contacts are arranged in a row behind the tail portions of the USB 2.0 contacts. Therefore, the tail portions of the USB 3.0 B type connector are arranged in three rows along the insertion direction. As a result, the tail portions occupy a larger area of the circuit board which is inconvenient to rout wires.

Hence, an improved electrical connector is desired to overcome the above problems.

BRIEF SUMMARY OF THE INVENTION

According to one aspect of the present invention, an electrical connector comprises: an insulative housing defining a first receiving cavity with a first tongue extending thereinto and a second receiving cavity with a second tongue extending thereinto, the second receiving cavity communicating with the first receiving cavity in an up to down direction and being essentially narrower than the first receiving cavity, the first tongue being parallel to the second tongue; a plurality of first contacts disposed on opposite first and second surfaces of the first tongue, each first contact having a flexible first contact portion cantileveredly protruding into the first receiving cavity and a first tail portion extending out of the insulative housing; and a plurality of second contacts disposed on a mounting surface of the second tongue, each second contact having a flat second contact portion exposed to the second receiving cavity and a second tail portion extending out of the insulative housing; wherein all first tail portions and second tail portions are arranged in a row.

According to another aspect of the present invention, an electrical connector comprises: an insulative housing defining a first receiving cavity with a first tongue extending thereinto and a second receiving cavity with a second tongue extending thereinto, the second receiving cavity communicating with the first receiving cavity in an up to down direction and being essentially narrower than the first receiving cavity, the first tongue being parallel to the second tongue; a plurality contacts having a plurality of first contacts disposed on opposite first and second surfaces of the first tongue and a plurality of second contacts disposed on a mounting surface of the second tongue, each first contact having a flexible first contact portion cantileveredly protruding into the first receiving cavity and a first tail portion extending out of the insulative housing; and each second contact having a flat second contact portion exposed to the second receiving cavity and a second tail portion extending out of the insulative housing; wherein the first and second contacts have a plurality of pairs of differential signal contacts and a plurality of grounding contacts, all first tail portions and second tail portions are arranged in a row along a transverse direction of the insulative housing, and there are at least a tail portion of the grounding contact located between the tail portions of adjacent two pairs of differential signal contacts.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
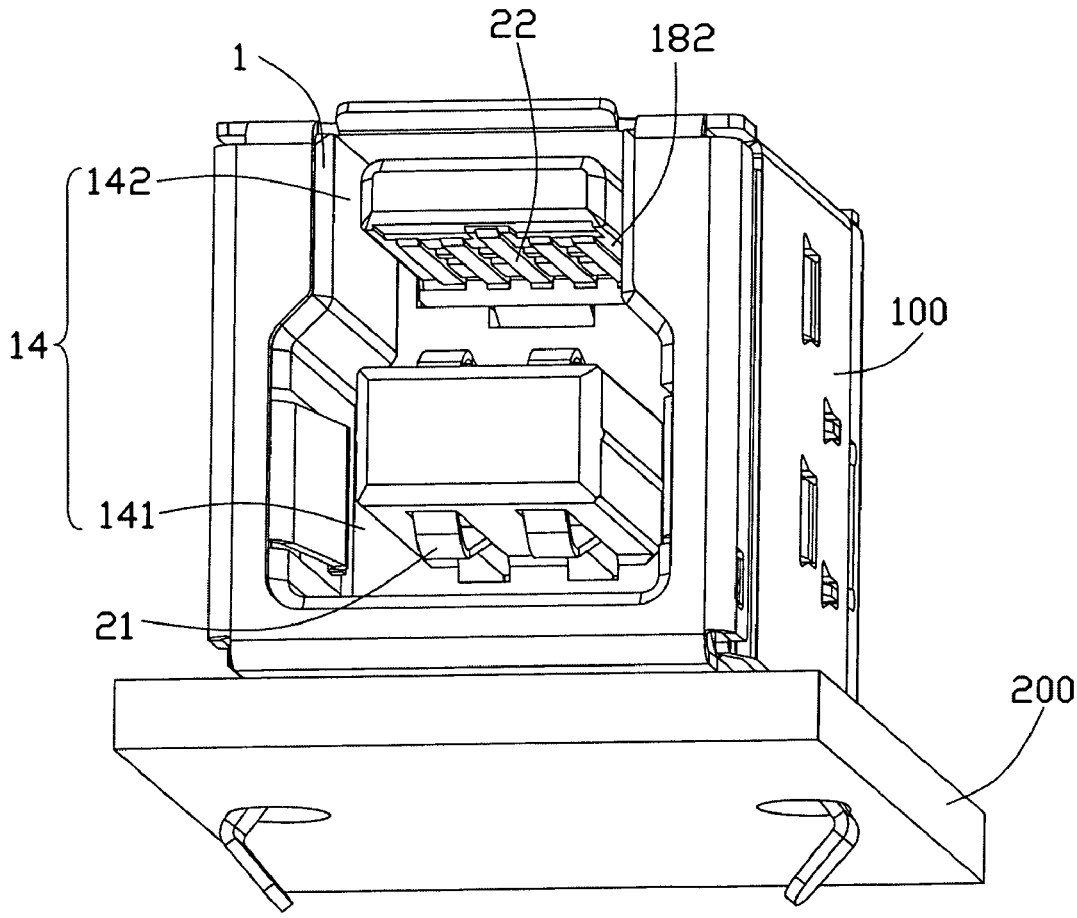
FIG. 1 is a perspective view of an electrical connector with a circuit board according to the present invention.
Figure 2:
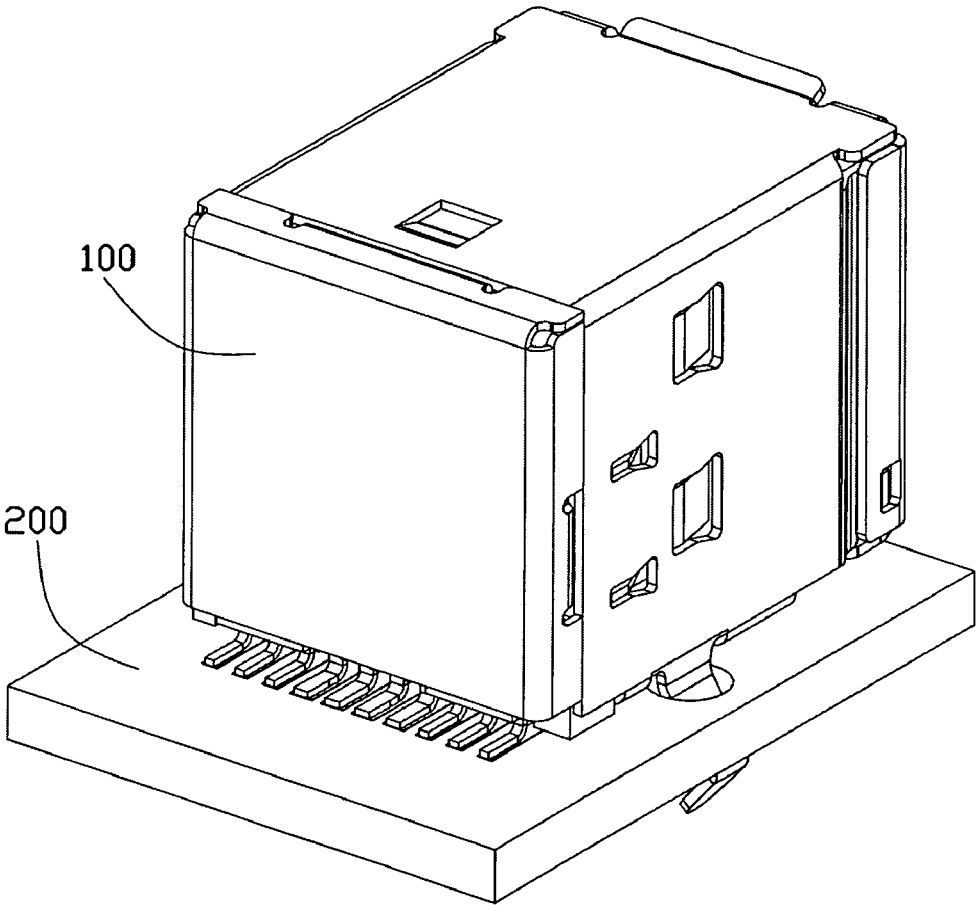
FIG. 2 is a view similar to FIG. 1, while taken from a different aspect.
Figure 3:
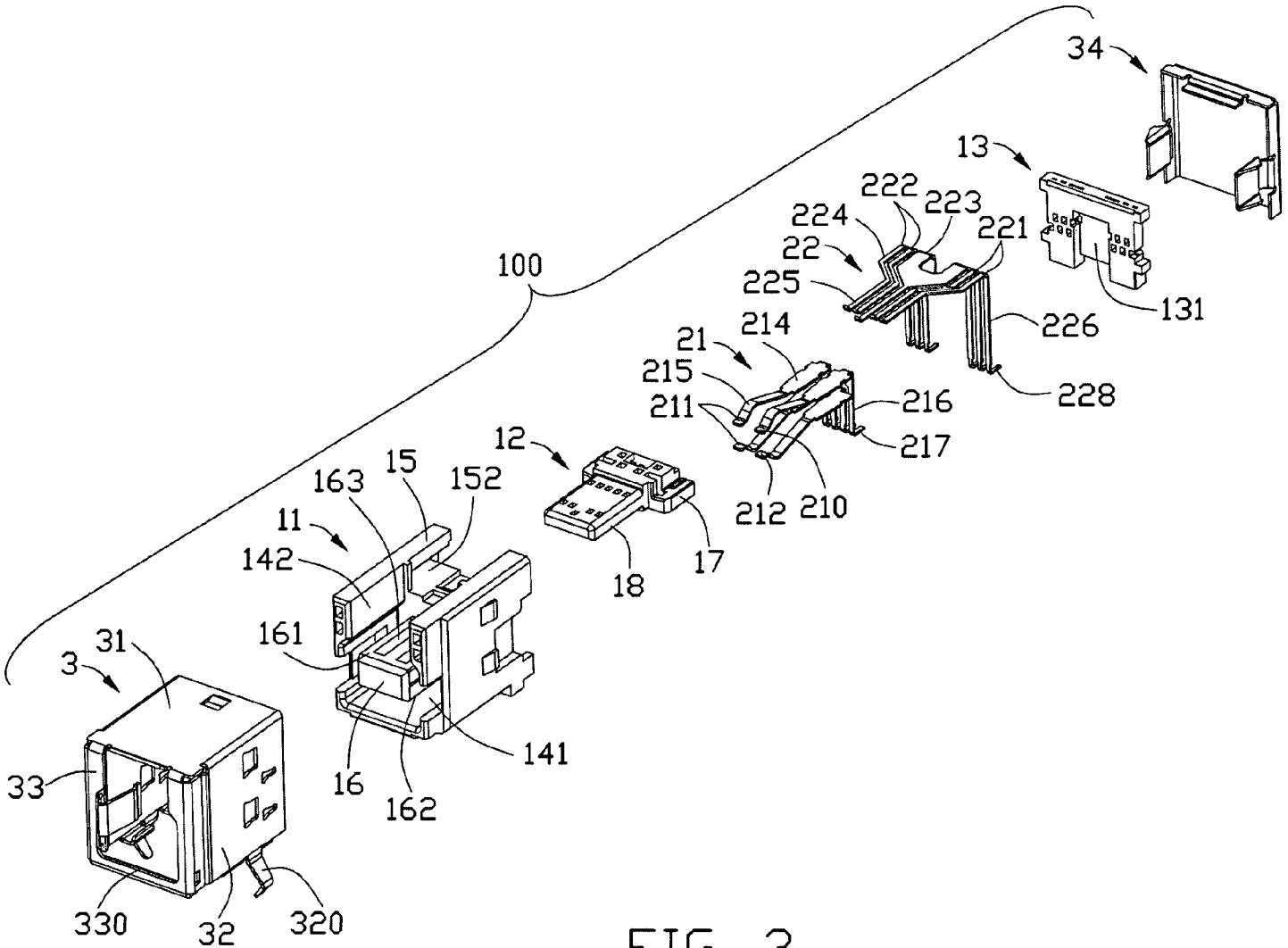
FIG. 3 is an exploded view of the electrical connector shown in FIG. 1.
Figure 4:
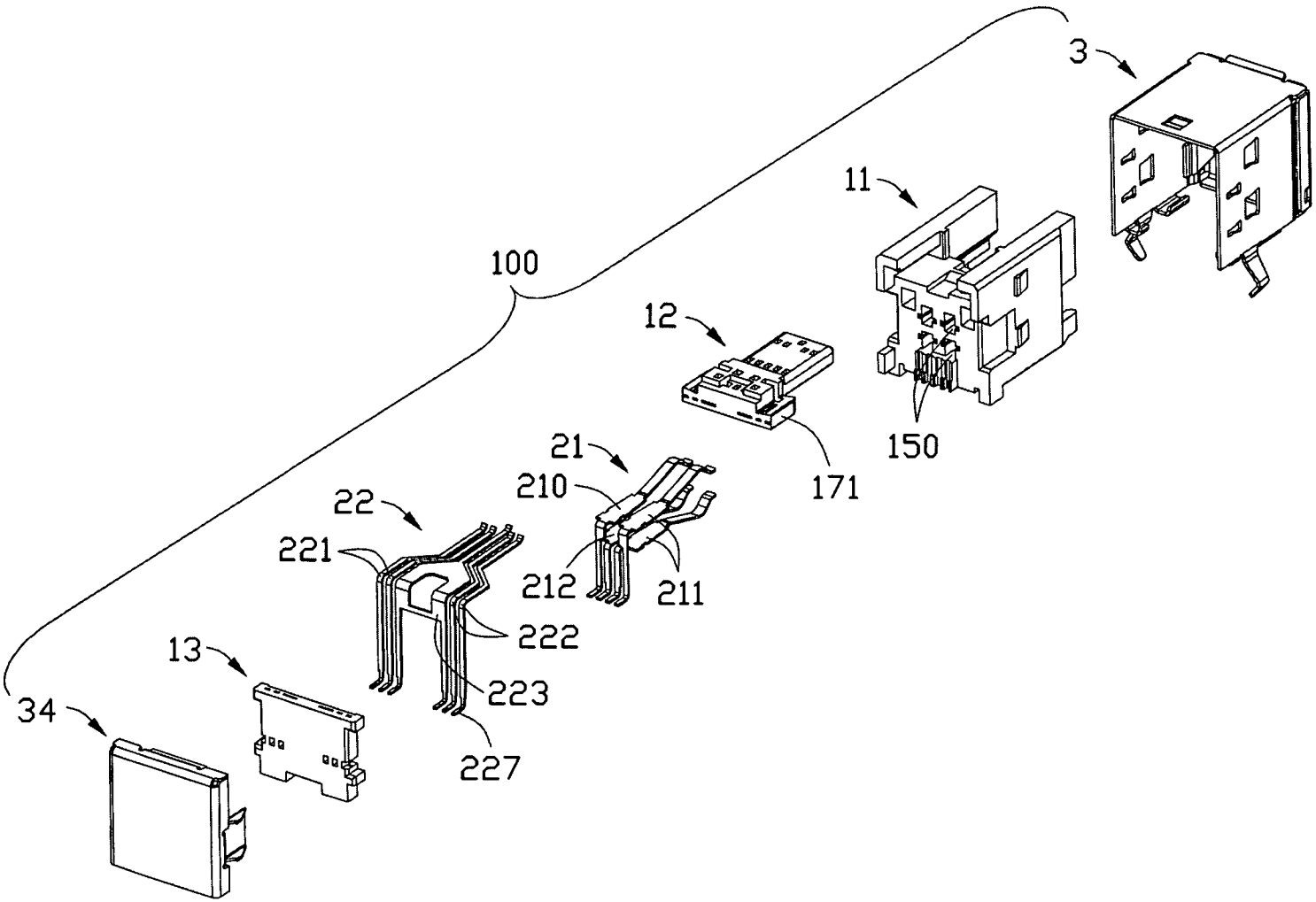
FIG. 4 is a view similar to FIG. 3, while taken from a different aspect.
Figure 5:
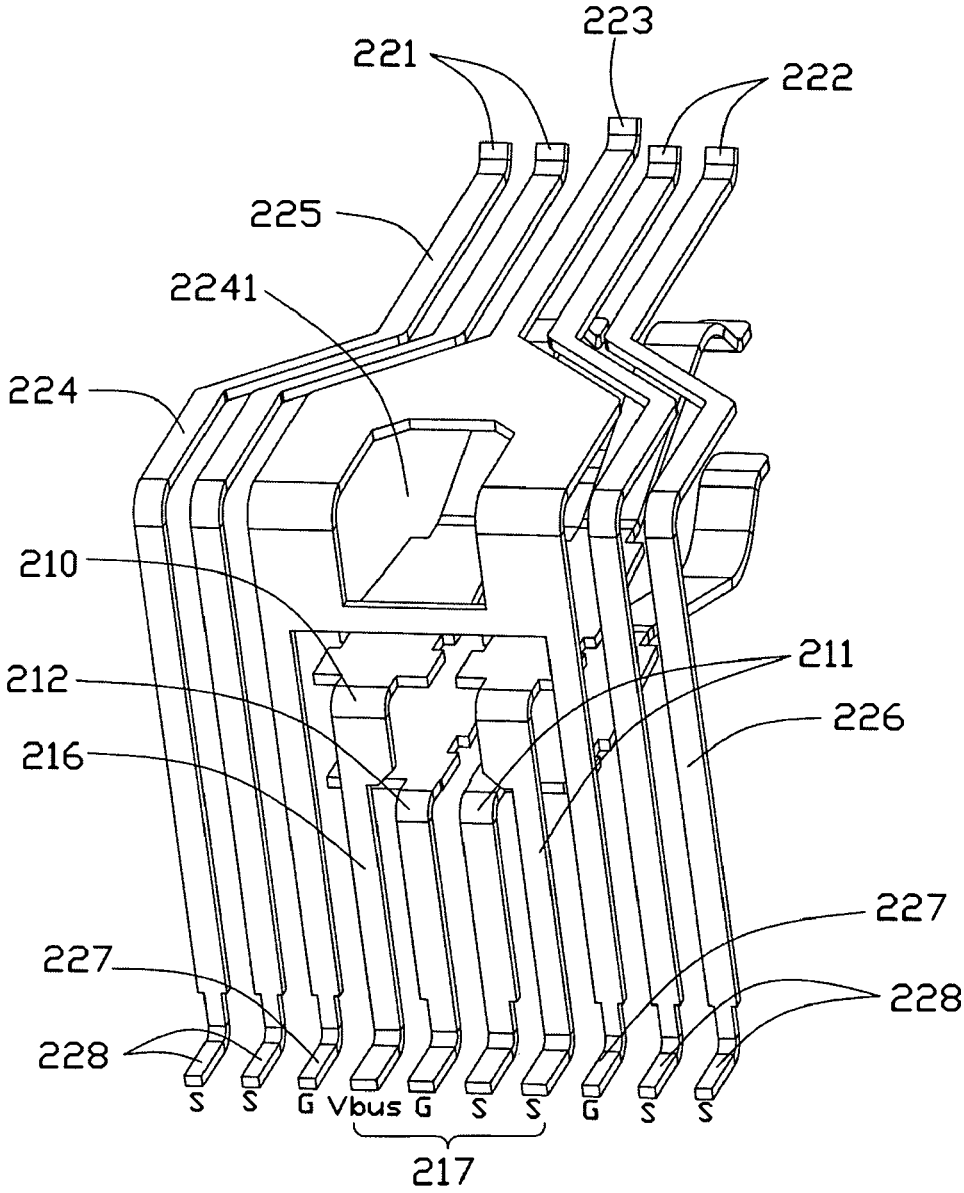
FIG. 5 is a perspective view of a plurality of contacts of the electrical connector shown in FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-5, an electrical connector 100 for soldering to a circuit board 200 according to a first embodiment in the present invention is an USB 3.0 B type receptacle connector which can mate with a standard USB 3.0 B type plug (not shown) or a standard USB 2.0 B type plug (not shown). The electrical connector 100 comprises an insulative housing 1, a plurality of contacts 2 attached to the insulative housing 1 and a metal shell 3 covering the insulative housing 1.

The insulative housing 1 comprises a first housing 11, a second housing 12 and a spacer 13 assembled together. The first housing 11 defines a mating port 14 for receiving the USB 3.0 or USB 2.0 B type plug. The mating port 14 has a first receiving cavity 141 and a second receiving cavity 142 located upper the first receiving cavity 141. The second receiving cavity 142 communicates with the first receiving cavity 141 in an up to down direction and is essentially narrower than the first receiving cavity 141. The first housing 11 has a first base portion 15 and a first tongue 16 integrally extending into the first receiving cavity 141. The first base portion 15 defines two pairs of passageways 150 extending therethrough along an insertion direction of the plug. The first tongue 16 has a pair of opposite first and second surface 161, 162 each of which defines a pair of slots 163 communicating with the passageways 150 respectively, and the first and second surface 161, 162 are upper and lower surfaces of the first tongue 16. The second housing 12 has a second base portion 17 and a second tongue 18 integrally extending into the second receiving cavity 142. The first tongue 16 is much thicker than the second tongue 18. The first base portion 15 defines a pair of grooves 152 extending forwardly from a rear and upper end thereof to retain the second housing 12. The second base portion 17 has a pair of ribs 171 extending outwardly from two sides thereof to engage with the grooves 152 for positioning the second housing 12 to the first housing 11. The second tongue 18 is parallel to the first tongue 16 and located upper the second tongue 18. The second tongue 18 has a mounting surface 182 opposed to the first surface 161.

The contacts 2 comprise a plurality of first contacts 21 disposed on the first and second surfaces 161, 162 of the first tongue 16 and a plurality of second contacts 22 disposed on the mounting surface 182 of the second tongue 18. The first contacts 21 are same to contacts of standard USB 2.0 B type receptacle (not shown) and can mate with the standard USB 2.0 B type plug. All first and second contacts 21, 21 consist of contacts of USB 3.0 B type receptacle to mate with the standard USB 3.0 B type plug.

The first contacts 21 comprise a power contact 210, a pair of first differential signal contacts 211 and a first grounding contact 212. Each first contact 21 has a first retaining portion 214 retained in the passageways 150 of the first housing 11, a flexible first contact portion 215 extending forwardly from a front end of the first retaining portion 214, a first connecting portion 216 extending downwardly from a rear end of the first retaining portion 214, and a first tail portion 217 extending backwardly and horizontally from a lower end of the first connecting portion 216. The first contact portions 215 are cantileveredly received in the slots 163 of the first tongue 16 and protrude into the first receiving cavity 141.

The first contact portions 215 of the power contact 210 and one of the pair of first differential signal contact 211 are disposed on the first surface 161, and the first contact portions 215 of the first grounding contact 212 and one of the first differential signal contacts 211 are disposed on the second surface 162. The first contact portions 215 of the pair of first differential signal contacts 211 are aligned with each other along the up to down direction. The first contact portions 215 of the power contacts 210 and the first grounding contact 212 are aligned with each other along the up to down direction. Therefore, an arrangement of the first contact portions 215 is same to that of the contacts of standard USB 2.0 B type receptacle.

The first tail portions 217 of the power contact 210 and one of the differential signal contacts 211 disposed on the first surface 161 are located at two sides of the first tail portions 217 of the grounding contact 212 and another differential signal contact 211. Therefore, the first contacts 21 are arranged one after another along a transverse direction of the insulative housing 1 in the first tail portions 217 are the power contacts 210, the first grounding contact 212 and the pair of differential signal contacts 211.

The second contacts 22 are insert molded in the second housing 12 and the spacer 13 and comprise two pairs of differential signal contacts 221, 222 and a grounding contact 223 between the two pairs of differential signal contacts 221. Each differential signal contact 221 has a second retaining portion 224 insert molded in the second housing 12, a second contact portion 225 extending forwardly from the second retaining portion 224, a second connecting portion 226 extending downwardly from a rear end of the second retaining portion 224, and a second tail portion 228 extending backwardly and horizontally from a lower end of the second connecting portion 226. The second grounding contact 223 has a second retaining portion 224 insert molded in the second housing 12, a second contact portion 225 extending forwardly from the second retaining portion 224, a pair of second connecting portions 226 extending downwardly from a rear end of the second retaining portion 224, and a pair of second tail portions 227 extending backwardly and horizontally from a lower end of the second connecting portion 226. The second retaining portion 224 of the second grounding contact 223 is wider than the other first and second retaining portions 214, 224 to assure a good grounding purpose. The second retaining portion 224 defines a hollow 2241 at a middle position thereof to prevent the connecting portion 226 from rebounding. The second connecting portions 226 of the second grounding contact 223 extend downwardly from two lower sides of the second retaining portion 224 thereof and spaced from each other along the transverse direction.

The second contact portions 225 of all second contacts 22 are disposed on the mounting surface 182 of the second tongue 18. An arrangement of the first and second contact portions 215, 225 disposed on the first and second tongues 16, 18 respectively is same to that of the standard USB 3.0 B type receptacle. The second housing 12 is insert molded around all second contact portions 225 and second retaining portions 224. The spacer 13 is insert molded around all second connecting portions 226. Therefore, the assemble process of the second contacts 22 can be reduced.

All first tail portions 217 are located between the second tail portions 227 of the second grounding contact 223 along the transverse direction, thereby the second tail portions 227 are located at two sides of all first tail portions 217 along the transverse direction. The spacer 13 defines a recession 131 recessed from a front side thereof and between two second connecting portions 224 of the second grounding contact 223 to receive all first connecting portions 216 in order to assure all first connecting portions 216 and all second connecting portions 226 located at a common vertical plane, and the second connecting portions 224 are located at two sides of all first connecting portions 216. Therefore, all connecting portions 216, 226 or all tail portions 217, 227, 228 are arranged one after other along the transverse direction as following: the pair of second differential signal contacts 221, the second grounding contact 223, the power contact 210, the first grounding contact 212, the pair of first differential signal contacts 211, the second grounding contact 223 and the pair of second differential signal contacts 222.

It is to see that there are two grounding contacts 223, 212 located between adjacent second and first differential signal contacts 221, 211 in the connecting portion 216 or the tail portion 217, 227, 228, which can reduce cross talk between the adjacent differential signal contacts 221, 211 and improve the signal transmission thereof. Besides, all tail portions 217, 227, 228 are bended backwardly and horizontally from the lower end of all connecting portions 216, 226 at the same time to make all tail portions 217, 227, 228 arranged in a row along the transverse direction. Therefore, the electrical connector 100 of the present invention can be surface mounted to the circuit board 200 and the circuit board 200 need not set a plurality of through holes to position the tail portions 217, 227, 228, which can strengthen the strength of the circuit board 200. Besides, all tail portions 217, 227, 228 are arranged in a row which can be convenient to rout wires and occupy a small area of the circuit board 200.

The metal shell 3 covers the insulative housing 1 to form said mating port 14 with the tongues 16, 18. The metal shell 3 has a top wall 31, a pair of side walls 32 bending downwardly from two sides of the top wall 31, a mating wall 33 partially covering a front side of the mating port 14 and a rear wall 34 covering a rear side of the insulative housing 1. Each side wall 33 has a mounting leg 320 extending downwardly from a lower end thereof to mount the electrical connector 100 to the circuit board 200. The mating wall 33 bending downwardly from a front end of the top wall 31 and has a pair of flanges to lock with two side walls 32. The mating wall 33 defines an opening 330 corresponding to the mating port 14.

Figure 6:
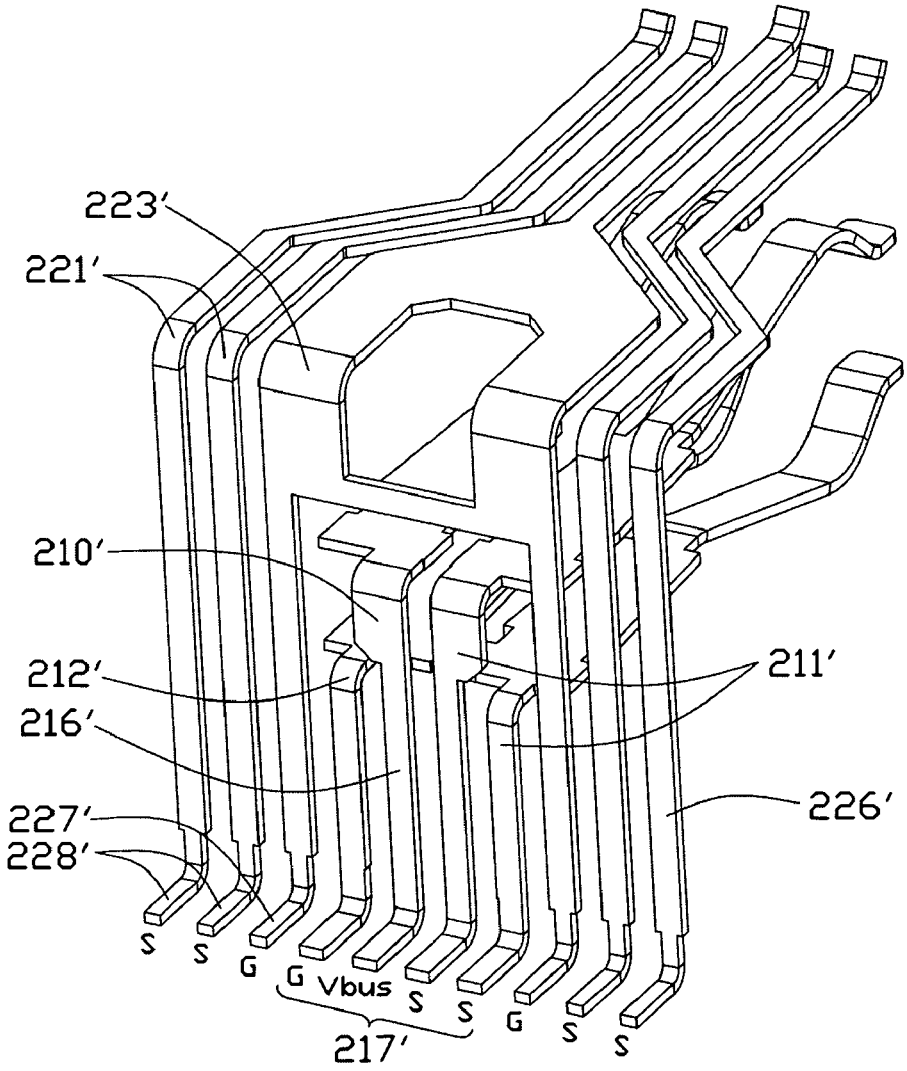
FIG. 6 is a view similar to FIG. 5, while taken from a different aspect.

Referring to FIG. 6, an electrical connector 100 according to a second embodiment of the present invention is disclosed. The electrical connectors in the first and second embodiments are approximately similar to each other, and the difference is that: the first connecting portions 216' or tail portions 217' of the power contact 230' and one of the first differential signal contacts 231' disposed on the first surface 161 of the first tongue 16 are located between that of the first grounding contact 232' and another first differential signal contact 231'. Therefore, all connecting portions 216', 226' or all tail portions 217', 227', 228' are arranged one after other along the transverse direction as following: the pair of second differential signal contacts 221', the second grounding contact 223', the first grounding contact 212', the power contact 210', the pair of first differential signal contacts 211', the second grounding contact 223' and the pair of second differential signal contacts 222'. It is to see that there are two grounding contacts 223', 212' located between adjacent second and first differential signal contacts 221', 211' in the connecting portion 216' or the tail portion 217', 227', 228', which can reduce cross talk between the adjacent differential signal contacts 221', 211' and improve the signal transmission thereof.

Of course, the electrical connector 100 in an alternative embodiment of the present invention can be designed as following: the second grounding contact can be designed to has only one second tail portion; all tail portions of the first contacts and the second contacts are arranged in a row along the transverse direction also; and the first tail portion of the first grounding contact and the second tail portion of the second grounding contact are arranged at two sides of the first tail portions of the two first differential signal contacts along the transverse direction, which can assure that there are at least a tail portion of the grounding contact located between the tail portions of adjacent two pairs of differential signal contacts along the transverse direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative housing defining a first receiving cavity with a first tongue extending thereinto and a second receiving cavity with a second tongue extending thereinto, the second receiving cavity communicating with the first receiving cavity in an up to down direction and being essentially narrower than the first receiving cavity, the first tongue being parallel to the second tongue;

a plurality of first contacts disposed on opposite first and second surfaces of the first tongue, each first contact having a flexible first contact portion cantileveredly protruding into the first receiving cavity and a first tail portion extending out of the insulative housing; and a plurality of second contacts disposed on a mounting surface of the second tongue, each second contact having a flat second contact portion exposed to the second receiving cavity and a second tail portion extending out of the insulative housing;

wherein all first tail portions and second tail portions are arranged in a row;

wherein all second tail portions are located at two sides of all first tail portions along a transverse direction of the insulative housing;

wherein the second contacts comprise two pairs of second differential signal contacts and a second grounding contact between the two pairs of second differential signal contacts, and the second grounding contact has a said second contact portion and a pair of said second tail portions, and all first tail portions are located between the pair of second tail portions;

wherein the first contacts comprise a power contact with a said first tail portion being closer to one second tail portion of the second grounding contact, and a pair of first differential signal contacts with a pair of said first tail portions being adjacent to another second tail portion of the second grounding contact, and a first grounding contact with a said first tail portion located between the first tail portions of the power contact and the pair of first differential signal contacts or the first tail portion of the power contact located between the first tail portions of the first grounding contact and the pair of first differential signal contacts;

wherein each first contact has a first retaining portion extending backwardly from the first contact portion and a first connecting portion extending downwardly from the first retaining portion and connecting the first retaining portion and the first tail portion together, and each second contact has a second retaining portion extending backwardly from the second contact portion and a second connecting portion extending downwardly from the second retaining portion and connecting the second retaining portion and the second tail portion together, and all first and second connecting portions are arranged in a common vertical plane;

wherein the second retaining portion of the second grounding contact defines a hollow at a middle portion thereof to prevent the second connecting portion of the second grounding contact from rebounding.

2. The electrical connector as claimed in claim 1, further comprising a spacer retained to the insulative housing and surrounding the second connecting portion, the spacer defines a recession recessed from a front side thereof to receive the first connecting portions and assure the first and second connecting portions located at the common vertical plane.

3. The electrical connector as claimed in claim 1, wherein the first tongue is much thicker than the second tongue and located below the second tongue, and an arrangement of the first and second contact portions disposed on the first and second tongue respectively is same to that of a standard USB 3.0 B type receptacle, and an arrangement of the first contact portions disposed on the first tongue is same to that of a standard USB 2.0 B type receptacle.

4. The electrical connector as claimed in claim 1, wherein all said first contacts are held in a first housing, and all said second contacts are held in a second housing, said first housing and said second housing being assembled together to form said insulative housing.

5. An electrical connector, comprising:

an insulative housing defining a first receiving cavity with a first tongue extending thereinto and a second receiving cavity with a second tongue extending thereinto, the second receiving cavity communicating with the first receiving cavity in an up to down direction and being essentially narrower than the first receiving cavity, the first tongue being parallel to the second tongue;

a plurality contacts having a plurality of first contacts disposed on opposite first and second surfaces of the first tongue and a plurality of second contacts disposed on a mounting surface of the second tongue, each first contact having a flexible first contact portion cantileveredly protruding into the first receiving cavity and a first tail portion extending out of the insulative housing; and each second contact having a flat second contact portion exposed to the second receiving cavity and a second tail portion extending out of the insulative housing;

wherein the first and second contacts have a plurality of pairs of differential signal contacts and a plurality of grounding contacts, all first tail portions and second tail portions are arranged in a row along a transverse direction of the insulative housing, and there are at least a tail portion of the grounding contact located between the tail portions of adjacent two pairs of differential signal contacts;

wherein all second tail portions are located at two sides of all first tail portions along the transverse direction; wherein the first contacts comprise a first grounding contact and a pair of first differential signal contacts, and the second contacts comprise two pairs of second differential signal contacts and a second grounding contact between two pairs of the second differential signal contacts, and the second tail portions of the second and first grounding contacts are located at two sides of the tail portions of the pair of first differential signal contacts;

wherein each first contact has a first retaining portion extending backwardly from the first contact portion and a first connecting portion extending downwardly from the first retaining portion and connecting the first retaining portion and the first tail portion together, and each second contact has a second retaining portion extending backwardly from the second contact portion and a second connecting portion extending downwardly from the second retaining portion and connecting the second retaining portion and the second tail portion together, and all first and second connecting portions are arranged in a common vertical plane;

wherein the second retaining portion of the second grounding contact defining a hollow at a middle position to prevent the second connecting portion of said second grounding contact from rebounding.

6. The electrical connector as claimed in claim 5, wherein the first tongue is much thicker than the second tongue and located below the second tongue, and an arrangement of the first and second contact portions disposed on the first and second tongue respectively is same to that of a standard USB 3.0 B type receptacle, and an arrangement of the first contact portions disposed on the first tongue is same to that of a standard USB 2.0 B type receptacle.

7. The electrical connector as claimed in claim 5, wherein all said first contacts are held in a first housing, and all said second contacts are held in a second housing, said first housing and said second housing being assembled together to form said insulative housing.

8. The electrical connector as claimed in claim 7, wherein the first tongue is integrally formed with the first housing, and the second tongue is integrally formed with the second housing, the second contacts are insert molded in the first housing.

9. An electrical connector comprising:

an insulative housing including an first mating tongue at an upper level and a second mating tongue at the lower level, being spaced from each other in a vertical direction;

a plurality of first contacts disposed in the housing and being equipped with a first center ground contact with first signal contacts by two sides of said first center ground contact, each of said first contacts including a corresponding first contacting section exposed upon the first mating tongue, and a corresponding first tail section behind the first contacting section;

a plurality of second contacts disposed in the housing, each of said second contacts including a corresponding second contacting section exposed upon the second mating tongue, and a corresponding second tail section behind the second contacting section;

the first tail section of the first center ground contact is split into two parts to receive the corresponding second tail sections therebetween in a transverse direction;

wherein the first tail sections are essentially spanned, in the transverse direction, outwardly in comparison with the first contacting sections to leave a space in a middle to receive the second tail sections; wherein said second contacts defines second upper contacts having the corresponding second contacting sections exposed upon an upper face of the second mating tongue, and second lower contacts having the corresponding second contacting sections exposed upon a lower face of the second mating tongue, and wherein the second tail section of the second upper contact cooperate with the first tail section of the first center ground contact to sandwich the second tail section of the corresponding second lower contact in said transverse direction;

each first contact has a first retaining portion extending backwardly from the first contact portion and a first connecting portion extending downwardly from the first;

retaining portion and connecting the first retaining portion and the first tail section together, and each second contact has a second retaining portion extending backwardly from the second contact portion and a second connecting portion extending downwardly from the second retaining portion and connecting the second retaining portion and the second tail section together, and all first and second connecting portions are arranged in a common vertical plane; wherein the second retaining portion of the second grounding contact defines a hollow at a middle portion thereof to prevent the second connecting portion of the second grounding contact from rebounding, wherein all first tail sections and second tail sections are arranged in a row.

* * * * *